US010328488B2

(12) United States Patent
Hanao et al.

(10) Patent No.: US 10,328,488 B2
(45) Date of Patent: Jun. 25, 2019

(54) MOLD FLUX FOR CONTINUOUS-CASTING TI-CONTAINING HYPO-PERITECTIC STEEL AND METHOD THEREFOR

(71) Applicant: NIPPON STEEL & SUMITOMO METAL CORPORATION, Tokyo (JP)

(72) Inventors: Masahito Hanao, Kashima (JP); Masaki Nagashima, Tokai (JP); Masatsugu Ishibashi, Himeji (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 245 days.

(21) Appl. No.: 15/311,910

(22) PCT Filed: Jun. 2, 2015

(86) PCT No.: PCT/JP2015/065859
§ 371 (c)(1),
(2) Date: Nov. 17, 2016

(87) PCT Pub. No.: WO2015/190347
PCT Pub. Date: Dec. 17, 2015

(65) Prior Publication Data

US 2017/0087624 A1 Mar. 30, 2017

(30) Foreign Application Priority Data

Jun. 10, 2014 (JP) ..... 2014-119918

(51) Int. Cl.
*B22C 3/00* (2006.01)
*B22D 11/00* (2006.01)
(Continued)

(52) U.S. Cl.
CPC ..... *B22D 11/108* (2013.01); *B22C 3/00* (2013.01); *B22D 11/001* (2013.01);
(Continued)

(58) Field of Classification Search
CPC ... B22D 11/108; B22D 11/001; B22D 11/111; B22D 11/049; C22C 38/002;
(Continued)

(56) References Cited

U.S. PATENT DOCUMENTS 6,386,271 B1 * 5/2002 Kawamoto ..... B22D 11/111 164/459
2011/0094703 A1 * 4/2011 Miyake ..... B22D 11/111 164/468
2017/0266718 A1 * 9/2017 Hanao ..... B22D 11/108

FOREIGN PATENT DOCUMENTS

JP 7-185755 7/1995
JP 08-141713 6/1996
(Continued)

OTHER PUBLICATIONS

Watanabe et al., "Stability of . . . Ca0—Si$0_2$—$CaF_2$ System", ISIJ International, vol. 42 (2002), No. 5, pp. 489-497.

*Primary Examiner* — Keith Walker
*Assistant Examiner* — John A Hevey
(74) *Attorney, Agent, or Firm* — Clark & Brody

(57) ABSTRACT

A mold flux is used in continuous casting of Ti-containing hypo-peritectic steel so as to prevent longitudinal cracks from forming on a surface of a slab. The mold flux contains CaO, $SiO_2$, an alkali metal oxide and a fluorine compound as major components. f(1), f(2) and f(3), which are calculated from the initial chemical composition, are (1.1−0.5×T) to (1.9−0.5×T), 0.05 to 0.40 and 0 to 0.40, respectively, if the Ti content of the molten steel (mass %) is T. The $TiO_2$ content in the melting state during the casting is no more than 20 mass % and the ratio of the first peak height of perovskite to the first peak height of cuspidine in the mold flux film is no more than 1.0.

1 Claim, 2 Drawing Sheets

(51) Int. Cl.

| | |
|---|---|
| ***C22C 38/00*** | (2006.01) |
| ***C22C 38/14*** | (2006.01) |
| ***B22D 11/049*** | (2006.01) |
| ***B22D 11/108*** | (2006.01) |
| ***B22D 11/111*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *B22D 11/049* (2013.01); *B22D 11/111* (2013.01); *C22C 38/002* (2013.01); *C22C 38/02* (2013.01); *C22C 38/04* (2013.01); *C22C 38/06* (2013.01); *C22C 38/14* (2013.01)

(58) Field of Classification Search
CPC ..... C22C 38/02; C22C 38/04; C22C 38/14; C22C 38/06; B22C 3/00
See application file for complete search history.

(56) References Cited

FOREIGN PATENT DOCUMENTS

| | | |
|---|---|---|
| JP | 08-197214 | 8/1996 |
| JP | 2001-179408 | 7/2001 |
| JP | 2006-289383 | 10/2006 |

* cited by examiner

MOLD FLUX FOR CONTINUOUS-CASTING TI-CONTAINING HYPO-PERITECTIC STEEL AND METHOD THEREFOR

TECHNICAL FIELD

This invention relates to mold flux that is used for continuous-casting Ti-containing hypo-peritectic steel, and a method for continuous-casting hypo-peritectic steel containing 0.1 to 1 mass % of Ti, using the mold flux.

BACKGROUND ART

When hypo-peritectic steel containing 0.08 to 0.18 mass % of C is continuous-cast, a solidified shell that is formed by solidification of molten steel in a mold tends to be unequal in thickness, which causes longitudinal cracks to easily form on a surface of a slab.

It is effective to mildly cooling the solidified shell (hereinafter, may be referred to as "mild cooling") in order to make the solidified shell in the mold equal in thickness. It is relatively easy to use mold flux for mild cooling.

The mold flux is supplied on molten steel in the mold, and melts with heat supplied from the molten steel. The mold flux in a melting state flows along the mold, to come into a gap between the mold and the solidified shell, and to form a mold flux film (hereinafter may be referred to as "film"). Just after the casting starts, this film is cooled by the mold, to solidify like glass. Crystals are educed from the glass as time passes. When crystallization of this film is promoted, the roughness of the surface of the film in the mold side increases, which causes the thermal resistance at the interface between the mold and the film (hereinafter may be referred to as "interfacial thermal resistance") to increase. Radiative heat transfer in the film is also suppressed. These effects allows the molten steel and the solidified shell touching the film to be mildly cooled down.

It is cuspidine ($Ca_4Si_2O_7F_2$) that is common composition of crystals educed from the film.

The following methods have been worked out as means for promoting crystallization of films:

A method for controlling fluid physical properties of mold flux, specifically, a method for raising the solidification point is effective for promoting crystallization of the film. About this method, Patent Literature 1 describes that crystallinity of a film is improved by raising the solidification point of mold flux to the range of 1150 to 1250° C. However, it is said there is a problem that if the solidification point of the mold flux is raised to 1250° C. or over, the lubricity is disturbed and breakout cannot be prevented.

A method for controlling components in mold flux, specifically, a method for increasing the ratio of the contents of CaO to $SiO_2$ (hereinafter may be referred to as "basicity") is also effective for promoting crystallization of the film. A method for reducing the MgO content in mold flux is also effective for promoting crystallization of the film. Concerning these methods, Patent Literature 2 discloses it is effective for crystallization of a film that in mold flux, the basicity is specified by 1.2 to 1.6 and the MgO content is specified by no more than 1.5 mass %. However, the highest temperature where the mold flux forms crystals disclosed in Patent Literature 2 is about 1150° C. at most, and only an effect of mild cooling corresponding to this is obtained. That is, the effect of mild cooling is insufficient.

On the other hand, Patent Literature 3 discloses a method for suppressing radiative heat transfer in a film by adding an iron oxide or a transition metal oxide to mold flux.

However, CaO, $SiO_2$, and $CaF_2$ in the mold flux are diluted by the addition of any of these oxides. Specifically, in Patent Literature 3, no less than 10 mass % of an iron oxide or a transition metal oxide in total has to be added as shown in its Examples in order to obtain a sufficient effect of suppressing radiative heat transfer. In this case, cuspidine is difficult to be educed when the composition has about 1.0 of the basicity shown in Examples of Patent Literature 3, and the solidification point of the mold flux drops. The solidification point shown in Examples of Patent Literature 3 is about 1050° C., which is lower than that in Patent Literature 1 by no less than 100° C. considering that the solidification point of the mold flux for hypo-peritectic steel suggested in Patent Literature 1 is about 1150 to 1250° C. As a result, crystallization of the film is blocked. Thus, with the art of Patent Literature 3, an effect of mild cooling obtained from increase of interfacial thermal resistance and the like according to the crystallization is marred.

Patent Literature 4 discloses a range of the composition of mold flux of the quaternary system of CaO—$SiO_2$—$CaF_2$—NaF where cuspidine is easily educed. The range of the composition is substantially same as a primary crystallization field of cuspidine as published in Non-Patent Literature 1 thereafter. According to the mold flux of Patent Literature 4 as described above, longitudinal cracks do not form on a surface of a slab when hypo-peritectic steel is rapidly cast, which makes it possible to obtain the slab which has a good surface quality.

Patent Literature 5 discloses a method for adding a transition metal oxide to the basic composition prepared within the range of Patent Literature 4, to drop the solidification point without marring an effect of mild cooling. Patent Literature 5 is aimed at the problem that when the Mn content in molten steel is high, crystallization of cuspidine is blocked because the MnO content in the film increases due to oxidation reaction of Mn, and thus the effect of mild cooling cannot be sufficiently obtained. For this problem, a necessary content of MnO is contained in advance, to suppress oxidation reaction of Mn, and then the solidification point is raised to a desired level. Whereby, it is possible to prevent longitudinal cracks on high-strength steel of the high Mn content from forming, according to Patent Literature 5.

CITATION LIST

Patent Literature

Patent Literature 1: JP H8-197214A
Patent Literature 2: JP H8-141713A
Patent Literature 3: JP H7-185755A
Patent Literature 4: JP2001-179408A
Patent Literature 5: JP2006-289383A

Non-Patent Literature

Non-Patent Literature 1: ISIJ International, Vol. 42 (2002), pp. 489 to 497

SUMMARY OF INVENTION

Technical Problem

As described above, in continuous casting of hypo-peritectic steel, longitudinal cracks easily form on a surface of a slab. It is effective for preventing the formation of longitudinal cracks to carry out mild cooling on the solidified shell, and mold flux can be used for this mild cooling.

However, the mold flux of Patent Literatures 1 to 3 as described above has the problems that the lubricity is disturbed and breakout cannot be prevented, and that the effect of mild cooling is insufficient.

On the other hand, according to the mold flux of Patent Literature 4, longitudinal cracks do not form on a surface of a slab when hypo-peritectic steel is rapidly cast, which makes it possible to obtain the slab which has a good surface quality. According to the mold flux of Patent Literature 5, it is possible to prevent longitudinal cracks on high-strength steel of the high Mn content from forming.

One of steel grades of hypo-peritectic steel is of no less than 0.1 mass % of the Ti content. In casting of this Ti-containing hypo-peritectic steel, $TiO_2$ forms in mold flux in a melting state through the influence of oxidation reaction of Ti in molten steel. This $TiO_2$ not only dilutes cuspidine in the solidified film, but also forms another new crystal phase, perovskite ($CaTiO_3$). Therefor, this perovskite grows up in the film unilaterally, and a glass phase (cuspidine) necessary for lubrication is marred. As a result, stable casting gets difficult, and the problem of forming longitudinal cracks on a surface of a slab rises.

Therefore, there is a case in the casting of Ti-containing hypo-peritectic steel that longitudinal cracks form on a surface of a slab through the influence of $TiO_2$ forming in the mold flux even if the mold flux of any of Patent Literatures 4 and 5 is used.

This invention was made in view of these problems. An object of this invention is, in continuous casting of Ti-containing hypo-peritectic steel, to provide mold flux that can prevent longitudinal cracks from forming on a surface of a slab and to provide a method for continuous-casting hypo-peritectic steel containing 0.1 to 1 mass % of Ti, using this mold flux.

Solution to Problem

The inventors of this invention found that in continuous casting of Ti-containing hypo-peritectic steel, the composition of mold flux in a melting state changes according to oxidation reaction of Ti in molten steel. Specifically, they found that the MnO and $TiO_2$ contents of the mold flux increase in its melting state from less than 0.1 mass % in its initial composition.

Further, they found that even if f(1), f(2) and f(3) described below, which are calculated from the initial composition of the mold flux, satisfy the formulas (1), (2) and (3) described below as well, composition changes in the mold flux in the melting state become large when the $TiO_2$ content of the mold flux in the melting state during casting exceeds 20 mass %. If the composition changes in the mold flux in the melting state become large, the ratio of the first peak height of perovskite to the first peak height of cuspidine (hereinafter may be merely referred to as "strength") which is obtained from X-ray diffraction analysis of powder obtained by pulverizing the film of the mold flux in a solidifying state after the casting takes a value more than 1.0, formation of cuspidine is blocked, and evaluation of continuous casting and longitudinal cracks becomes "failure". Thus, it is important for preventing longitudinal cracks on a surface of a slab from forming in continuous casting of Ti-containing hypo-peritectic steel that the $TiO_2$ content of mold flux in the melting state during the casting is less than 20 mass % and the strength ratio is no more than 1.0. This invention was made based on these findings. The gist of this invention is as follows.

A first aspect of this invention is mold flux for continuous-casting Ti-containing hypo-peritectic steel, wherein in continuous casting of Ti-containing hypo-peritectic steel, the mold flux contains CaO, $SiO_2$, an alkali metal oxide and a fluorine compound as major components, chemical composition of the mold flux before the mold flux is put into a mold satisfies the formulas (1), (2) and (3), a $TiO_2$ content of the mold flux in a melting state during the casting is no more than 20 mass %, and a strength ratio of a film of the mold flux in a solidifying state after the casting is no more than 1.0:

$$1.1-0.5\times T\leq f(1)\leq 1.9-0.5\times T \quad (1)$$

$$0.05\leq f(2)\leq 0.40 \quad (2)$$

$$0\leq f(3)\leq 0.40 \quad (3),$$

wherein in the formulas (1) to (3), $$f(1)=(CaO)_h/(SiO_2)_h \quad (A)$$

$$f(2)=(CaF_2)_h/\{(CaO)_h+(SiO_2)_h+(CaF_2)_h\} \quad (B)$$

$$f(3)=\{(\text{alkali metal fluoride})_h\}/\{(CaO)_h+(SiO_2)_h+(\text{alkali metal fluoride})_h)\} \quad (C),$$

wherein in the formulas (A) to (C), $$(CaO)_h=W_{CaO}-(CaF_2)_h\times 0.718 \quad (D)$$

$$(SiO_2)_h=W_{SiO2} \quad (E)$$

$$(CaF_2)_h=(W_F-W_{Li2O}\times 1.27-W_{Na2O}\times 0.613-W_{K2O}\times 0.403)\times 2.05 \quad (F)$$

$$(\text{alkali metal fluoride})_h=W_{Li2O}\times 1.74+W_{Na2O}\times 1.35+W_{K2O}\times 1.23 \quad (G)$$

wherein T is a Ti content of molten steel (mass %), $W_{CaO}$ is a CaO content of the mold flux (mass %), $W_{SiO2}$ is a $SiO_2$ content of the mold flux (mass %), $W_F$ is a F content of the mold flux (mass %), and $W_{Li2O}$, $W_{Na2O}$ and $W_{K2O}$ are contents of $Li_2O$, $Na_2O$ and $K_2O$ respectively, which are alkali metal oxides, of the mold flux (mass %), and wherein the strength ratio of the film means a ratio of a first peak height of perovskite (strength of an angle (33.2°), which is twice as wide as a Bragg angle when Co was a source, X2) to a first peak height of cuspidine (strength of an angle (29.2°), which is twice as wide as a Bragg angle when Co was a source, X1), the ratio (X2/X1) being obtained from X-ray diffraction analysis of powder obtained by pulverizing the film of the mold flux.

A second aspect of this invention is a method for continuous-casting Ti-containing hypo-peritectic steel, the method comprising: continuous-casting hypo-peritectic steel containing 0.1 to 1 mass % of Ti, using the mold flux of the above first aspect of this invention.

" . . . contains CaO, $SiO_2$, an alkali metal oxide and a fluorine compound as major components" in this invention means that the content of each object component is no less than 5 mass %, and the total content thereof is no less than 70 mass %.

Advantageous Effects of Invention

Each of the indexes (f(1), f(2) and f(3)) of the mold flux for continuous-casting Ti-containing hypo-peritectic steel of this invention (hereinafter may be referred to as "mold flux of this invention") is prepared within a predetermined range; these indexes are calculated from the chemical composition before the mold flux is supplied into a mold (hereinafter may be referred to as "initial chemical composition"). Moreover, the $TiO_2$ content in the melting state during the casting is no more than 20 mass % and the strength ratio of the film in the solidifying state after the casting is no more than 1.0. Whereby, even if the composition of the mold flux in the melting state changes according to oxidation reaction of Ti in molten steel, cuspidine stabilizes in a crystal phase in the film, and a state where cuspidine is dominant over perovskite can be kept. As a result, effects of lubricity and mild cooling in the mold are stable, to prevent longitudinal cracks on a surface of a slab from forming.

The method for continuous-casting Ti-containing hypo-peritectic steel of this invention (hereinafter may be referred to as "continuous casting method of this invention") uses the above described mold flux of this invention. Whereby, cuspidine stabilizes in a crystal phase in the film that is formed in the mold, and the state where cuspidine is dominant over perovskite can be kept. As a result, the effects of lubricity and mild cooling in the mold are stable, to prevent longitudinal cracks on a surface of a slab from forming.

DESCRIPTION OF EMBODIMENTS

Figure 1:
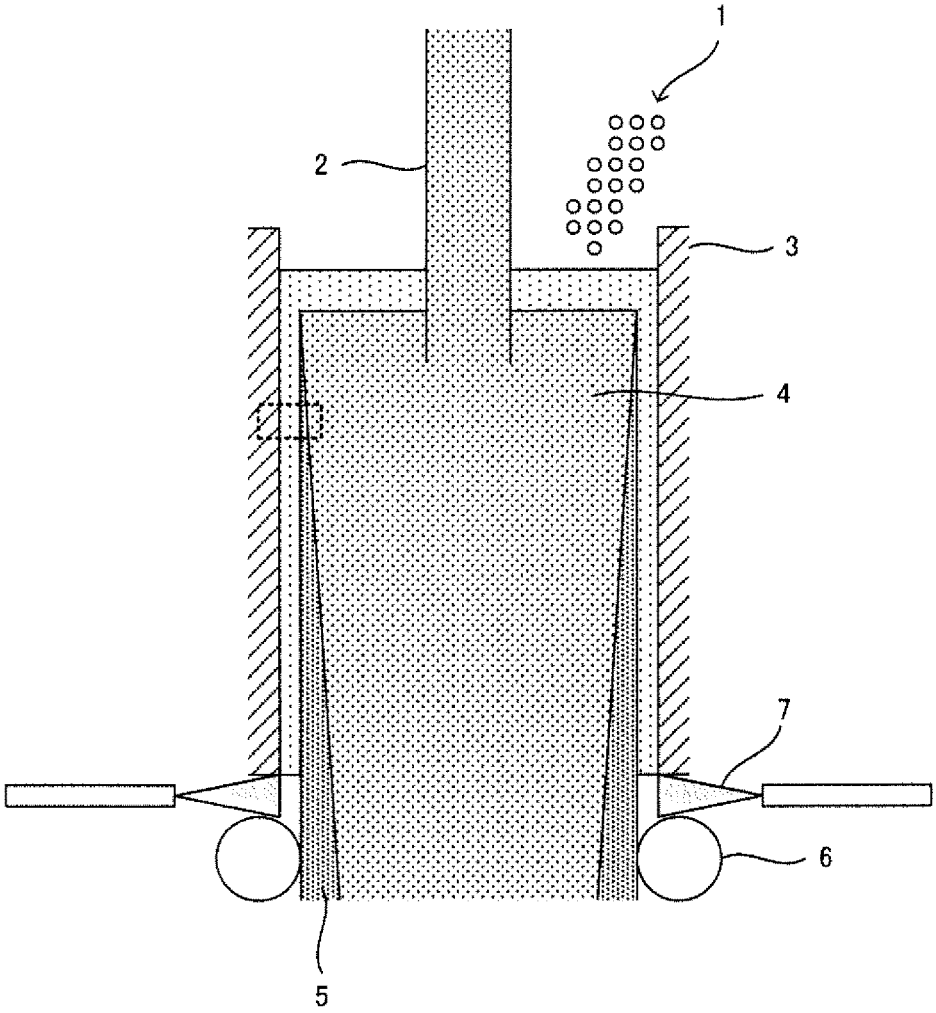
FIG. 1 is a view showing the mold flux and the continuous casting method of this invention.
Figure 2:
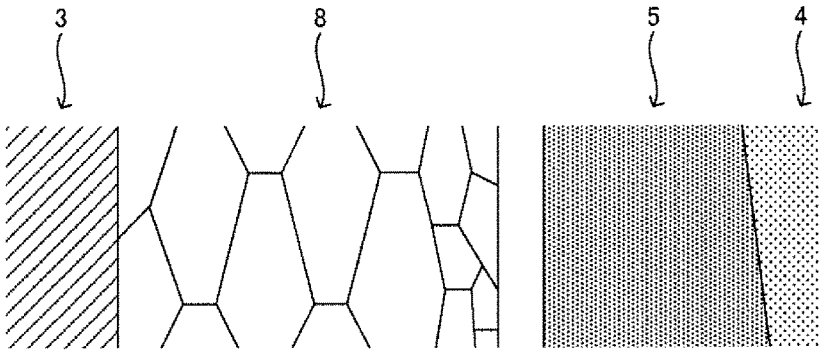
FIG. 2 is a cross-sectional view showing partially enlarged FIG. 1.

FIG. 1 is a view showing this invention. FIG. 2 is a cross-sectional view showing a part of FIG. 1 surrounded by a dashed line enlarged. This invention will be described below with reference to FIGS. 1 and 2 when demanded. "X to Y" means "no less than X and no more than Y" unless there is any special mention.

As shown in FIG. 1, mold flux 1 of this invention is supplied on the surface of molten steel 4 that is poured into a mold 3 via a submerged nozzle 2. The mold flux 1 of this invention supplied in this way melts with heat supplied from the molten steel 4. After that, as shown in FIG. 2, the mold flux 1 flows along the mold 3, and comes into a gap between the mold 3 and a solidified shell 5, to form a film 8. The solidified shell 5, which is formed by cooling from the side of the mold 3 that is cooled by cooling means not shown, is withdrawn toward a lower part of the mold 3 with rolls 6, and is cooled by cooling water 7. In the continuous casting method of this invention, hypo-peritectic steel containing 0.1 to 1 mass % of Ti is continuous-cast in this way.

The reasons why the mold flux and continuous casting method of this invention are specified like the above, and preferred embodiments thereof will be described below.

The mold flux of this invention contains CaO, $SiO_2$, an alkali metal oxide and a fluorine compound as major components. CaO, $SiO_2$ and a fluorine compound are contained as essential components for cuspidine that bears crystallization. An alkali metal oxide is contained as a component for controlling the solidification point of the flux relatively easily.

As described above, in the continuous casting of hypo-peritectic steel containing 0.1 to 1 mass % of Ti, the chemical composition of the mold flux changes according to oxidation reaction of Ti in the molten steel in the mold. Thus, each of the indexes f(1), f(2) and f(3), hereinafter the same will be referred to) of the mold flux of this invention, which is calculated from the initial chemical composition, is prepared within a predetermined range. Here, "initial chemical composition" means the composition before the supply into the mold for continuous casting. The intention is to exclude the composition changes in the mold flux according to oxidation reaction of Ti in the molten steel.

The preparation of the indexes makes cuspidine stabilize in a crystal phase in the film even if the composition of the mold flux in the melting state (hereinafter may be referred to as "melting mold flux") changes according to oxidation reaction of Ti in the molten steel. Thus, a state where cuspidine is dominant over perovskite is easily kept. As a result, the effects of lubricity and mild cooling in the mold can be stable, and longitudinal cracks on a surface of a slab can be prevented from forming.

Specifically, the initial chemical composition satisfies the following formulas (1), (2) and (3). That is, the indexes (f(1), f(2) and f(3)), which are calculated from the initial chemical composition using the following formulas (A) to (H), satisfy the following formulas (1), (2) and (3), respectively.

$$1.1-0.5\times T\leq f(1)\leq 1.9-0.5\times T \quad (1)$$

$$0.05\leq f(2)\leq 0.40 \quad (2)$$

$$0\leq f(3)\leq 0.40 \quad (3),$$

The indexes f(1) to f(3) are specified by the following formulas (A) to (G).

$$f(1)=(CaO)_h/(SiO_2)_h \quad (A)$$

$$f(2)=(CaF_2)_h/\{(CaO)_h+(SiO_2)_h+(CaF_2)_h\} \quad (B)$$

$$f(3)=\{\text{alkali metal fluoride})_h\}/\{(CaO)_h+(SiO_2)_h+(\text{alkali metal fluoride})_h)\} \quad (C)$$

$$(CaO)_h=W_{CaO}-(CaF_2)_h\times 0.718 \quad (D)$$

$$(SiO_2)_h=W_{SiO2} \quad (E)$$

$$(CaF_2)_h=(W_F-W_{Li2O}\times 1.27-W_{Na2O}\times 0.613-W_{K2O}\times 0.403)\times 2.05 \quad (F)$$

$$\text{alkali metal fluoride})_h=W_{Li2O}\times 1.74+W_{Na2O}\times 1.35+W_{K2O}\times 1.23 \quad (G)$$

Here T is the Ti content in the molten steel (mass %), $W_{CaO}$ is the CaO content in the mold flux (mass %), $W_{SiO2}$ is the $SiO_2$ content in the mold flux (mass %), $W_F$ is the F content in the mold flux (mass %), and $W_{Li2O}$, $W_{Na2O}$ and $W_{K2O}$ are the contents of $Li_2O$, $Na_2O$ and $K_2O$ respectively, which are alkali metal oxides, in the mold flux (mass %).

The index f(1), which is calculated using the formula (A), is a ratio of the CaO content to the $SiO_2$ content in view of $CaF_2$, and is an important index to promote crystallization of cuspidine.

Here, in the case of hypo-peritectic steel whose Ti content is less than 0.1 mass %, the value of f(1) has to take 1.1 to 1.9 in order to keep the composition of the melting mold flux within the range of the composition of a primary crystal of cuspidine.

In the case of hypo-peritectic steel containing 0.1 to 1 mass % of Ti, $SiO_2$ in the melting mold flux is reduced by reaction with Ti in the molten steel in the mold. Therefore, such a situation arises that even if f(1) from the initial chemical component is within the above described range (1.1 to 1.9), the value of f(1) from the composition of the melting mold flux is far beyond the preferred state. Thus, f(1) from the initial chemical composition is prepared so as to be low according to the Ti content of the molten steel, and thereby the value of f(1) from the composition of the melting mold flux is set within the above described range (1.1 to 1.9). As a result, the value of f(1) from the composition of the melting mold flux increases because of the reaction in the mold, and the composition of the melting mold flux can be kept within the range of the composition of a primary crystal of cuspidine.

Specifically, f(1) of the mold flux of this invention has to be (1.1−0.5×T) to (1.9−0.5×T). In view of more stable crystallization of cuspidine, the upper limit of f(1) is preferably (1.7−0.5×T), and more preferably (1.5−0.5×T). In the same view, the lower limit of f(1) is preferably (1.2−0.5×T), and more preferably (1.3−0.5×T).

The index f(2) calculated using the formula (B) indicates a proportion of $CaF_2$ for the total content of CaO, $SiO_2$ and $CaF_2$, and is an important index to promote crystallization of cuspidine. Setting f(2) in 0.05 to 0.40 makes it possible to keep the composition of the melting mold flux within the range of the composition of a primary crystal of cuspidine. In view of more stable crystallization of cuspidine, the upper limit of f(2) is preferably 0.3, and more preferably 0.25. In the same view, the lower limit of f(2) is preferably 0.1, and more preferably 0.15.

The index f(3) calculated using the formula (C) indicates a proportion of a component that plays a role like a solvent for cuspidine. Setting f(3) in no more than 0.4 makes it possible to keep crystallization of cuspidine. The lower limit of f(3) is 0 according to the definition of the formula (C). In view of more stable crystallization of cuspidine, the upper limit of f(3) is preferably 0.20, and more preferably 0.15. In the same view, the lower limit of f(3) is preferably 0.05, and more preferably 0.10.

The f(1), f(2) and (3) of the mold flux of this invention from the initial chemical composition satisfy the formulas (1), (2) and (3), respectively. Whereby, even if the composition changes according to reaction with the molten steel, cuspidine stabilizes in a crystal phase in the film, and the state where cuspidine is dominant over perovskite can be kept.

The $TiO_2$ content of the mold flux of this invention in the melting state in the casting is no more than 20 mass %, and the strength ratio of the film of the mold flux of this invention in the solidifying state after the casting is no more than 1.0. No more than 20 mass % of the $TiO_2$ content of the melting mold flux makes it possible to suppress composition changes in the melting mold flux. Thus, cuspidine stabilizes in a crystal phase in the film, and the state where cuspidine is dominant over perovskite can be kept. No more than 1.0 of the strength ratio of the film of the mold flux in the solidifying state after the casting makes it possible not to block formation of cuspidine. No more than 20 mass % of the $TiO_2$ content of the melting mold flux and no more than 1.0 of the strength ratio of the film of the mold flux in the solidifying state after the casting in addition to the satisfaction of the formulas (1), (2) and (3) makes it possible to prevent longitudinal cracks from forming on a surface of a slab.

The solidification point of the mold flux is preferably 1150 to 1400° C. If the solidification point is under 1150° C., crystallization of cuspidine might be poor. It is technically difficult to make the solidification point over 1400° C. The solidification point of 1150 to 1400° C. improves the effect of mild cooling by film. Thus, longitudinal cracks can be surely prevented from forming.

The viscosity of the mold flux is preferably no more than 2 poises (=0.2 Pa·s) at 1300° C. If the viscosity is over 2 poises, the crystallization rate might be down. If the viscosity is no more than 2 poises, the effect of mild cooling by film is improved and longitudinal cracks can be surely prevented from forming. On the other hand, concerning the lower limit of the viscosity, there arises no problem due to low viscosity. However, it is difficult to make the viscosity of generally used mold flux less than 0.1 poise (=0.01 Pa·s). Thus, no less than 0.1 poise is preferable.

When the Ti content of hypo-peritectic steel is no less than 0.1 mass %, the problem is outstanding that longitudinal cracks form on a surface of a slab through the influence of oxidation reaction of Ti in the steel. In contrast, when the Ti content of hypo-peritectic steel exceeds 1 mass %, composition changes in the melting mold flux in the mold through the influence of oxidation reaction of Ti in the molten steel become large. As a result, it becomes difficult to keep the composition of the melting mold flux within the range of the composition of a primary crystal of cuspidine. Therefore, the hypo-peritectic steel continuous-cast using the mold flux of this invention is specified as hypo-peritectic steel containing 0.1 to 1 mass % of Ti.

In this invention, for example, at least one of $Li_2O$, $Na_2O$ and $K_2O$ can be used as an alkali metal oxide. For example, fluorite that contains $CaF_2$ as a major component, or NaF can be used as a fluorine compound.

In addition, $Al_2O_3$ may be contained in the mold flux of this invention in order to adjust physical properties such as the solidification point and the viscosity. $Al_2O_3$ has the functions of dropping the solidification point and increasing the viscosity. However, the $Al_2O_3$ content is preferably low in order to promote crystallization of cuspidine. The $Al_2O_3$ content is preferably no more than 5 mass %. In contrast, when general raw materials for mold flux are used, about 0.5 mass % or more of $Al_2O_3$ is inevitably contained therein. While the $Al_2O_3$ content can be less than 0.5 mass % by using artificial raw materials like a pre-melting base material, it might be accompanied by a rise in raw material costs. Therefore, the $Al_2O_3$ content is preferably no less than 0.5 mass %.

The continuous casting method of this invention is directed to hypo-peritectic steel containing 0.1 to 1 mass % of Ti. The method uses the above described mold flux of this invention as mold flux. Whereby, the composition of a crystal phase in the film formed in the mold is maintained during the casting. That is, the state where cuspidine is dominant over perovskite in a crystal phase in the film can be kept during the casting. Thus, the effects of lubricity and mild cooling in the mold can be stable, and longitudinal cracks on a surface of a slab can be prevented.

The continuous casting method of this invention has no specific limitation to the casting conditions other than the mold flux. That is, the casting conditions can be properly set as well as a conventional continuous casting method.

EXAMPLES

For confirming effects of the mold flux and continuous casting method of this invention, continuous casting tests were carried out and results thereof were evaluated.

In these tests, a slab was continuous-east from 2.5 ton of molten steel while the mold flux was supplied onto the molten steel in a mold. At this time, the withdrawal rate was 1.0 m/min, and the size of the slab was: 500 mm in width, 84 mm in thickness and 7000 mm in length.

Table 1 shows grades (symbol), initial chemical composition (mass %), basicities, solidification points (° C.) and viscosities (poise) at 1300° C. of the mold flux used for the tests. Table 2 shows the chemical composition (mass %) of the molten steel used for the tests.

TABLE 1

| Mold Flux | | | | | | | | | | | |
|---|---|---|---|---|---|---|---|---|---|---|---|
| Grade | Initial Chemical Composition (mass %) | | | | | | | | Basicity | Solidification | Viscosity |
| (Symbol) | $SiO_2$ | CaO | $Al_2O_3$ | MgO | $Na_2O$ | MnO | $TiO_2$ | F | (—) | Point (° C.) | (poise) |
| A1 | 29.2 | 49.7 | 3.9 | 0.6 | 5.8 | <0.1 | <0.1 | 10.8 | 1.7 | 1245 | 0.5 |
| A2 | 33.5 | 46.8 | 2.5 | 0.5 | 6.1 | <0.1 | <0.1 | 10.6 | 1.4 | 1228 | 0.7 |
| R1 | 33.8 | 39.5 | 7.2 | 0.6 | 10.8 | <0.1 | <0.1 | 8.1 | 1.2 | 1210 | 2.3 |
| R2 | 38.0 | 38.0 | 2.8 | 0.4 | 12.8 | <0.1 | <0.1 | 8.0 | 1.0 | 1190 | 1.5 |
| R3 | 39.2 | 27.4 | 2.2 | 0.5 | 19.0 | <0.1 | <0.1 | 10.0 | 0.7 | 1050 | 1.5 |

TABLE 2

| Chemical Composition of Molten Steel (unit: mass %) Remainder: Fe and Impurities | | | | | | |
|---|---|---|---|---|---|---|
| C | Si | Mn | P | S | Ti | Al |
| 0.09-0.11 | 0.10-0.20 | 1.30-1.40 | 0.010-0.015 | 0.002-0.005 | 0.1-1.2 | 0.01-0.04 |

Test numbers 1 to 7 were set in the tests. The grade of the mold flux and the chemical composition of the molten steel were changed in each test. Table 3 shows grades of the mold flux, the Ti contents in the molten steel (mass %), values of f(1), f(2) and f(3) calculated using the initial chemical composition (hereinafter may be referred to as "initial composition"), and test categories used in the tests.

TABLE 3

| | | Mold Flux | | | | |
|---|---|---|---|---|---|---|
| Test Number | Ti Content in Molten Steel (mass %) | Grade | f(1) from Initial Composition | f(2) from Initial Composition | f(3) from Initial Composition | Test Category |
| 1 | 0.19 | A1 | 1.34 | 0.18 | 0.10 | Ex. of This Invention |
| 2 | 0.42 | A1 | 1.34 | 0.18 | 0.10 | Ex. of This Invention |
| 3 | 0.41 | A2 | 1.10 | 0.06 | 0.10 | Ex. of This Invention |
| 4 | 1.12 | A1 | 1.34 | 0.18 | 0.10 | Comp. Ex. |
| 5 | 0.20 | R1 | 1.11 | 0.04 | 0.17 | Comp. Ex. |
| 6 | 0.18 | R2 | 0.99 | 0 | 0.19 | Comp. Ex. |
| 7 | 0.19 | R3 | 0.70 | 0 | 0.28 | Comp. Ex. |

In each test, the mold flux in the melting state was taken out of the mold during the casting, and its components were analyzed. Table 4 shows the chemical composition of the mold flux in the melting state, and values of f(1), f(2) and f(3) calculated using the composition in the melting state.

The film in a solidifying state was taken out of the mold when the casting was ended, and pulverizing was carried out on the film to obtain powder. The obtained powder underwent X-ray diffraction analysis. From the results of the diffraction analysis, the strength of cuspidine and the strength of perovskite were obtained, to calculate the ratio (X2/X1) of the strength of perovskite (X2) to the strength of cuspidine (X1). At this time, the strength of cuspidine was the first peak height, specifically, the strength of an angle (29.2°), which was twice as wide as a Bragg angle when Co was a source. The strength of perovskite was the first peak

TABLE 4

| | Mold Flux | | | | | | | | | | | |
|---|---|---|---|---|---|---|---|---|---|---|---|---|
| Test | | Chemical Composition in Melting State (mass %) | | | | | | | | f(1) in Melting | f(2) in Melting | f(3) in Melting |
| Number | Grade | $SiO_2$ | CaO | $Al_2O_3$ | MgO | $Na_2O$ | MnO | $TiO_2$ | F | State | State | State |
| 1 | A1 | 24.1 | 47.1 | 5.4 | 0.5 | 5.6 | 1.3 | 5.8 | 10.2 | 1.5 | 0.18 | 0.11 |
| 2 | A1 | 19.8 | 45.6 | 6.8 | 0.5 | 5.7 | 1.4 | 9.7 | 10.5 | 1.8 | 0.21 | 0.12 |
| 3 | A2 | 21.6 | 43.2 | 7.1 | 0.4 | 5.8 | 1.3 | 10.2 | 10.4 | 1.5 | 0.20 | 0.13 |
| 4 | A1 | 13.0 | 37.7 | 10.3 | 0.5 | 5.2 | 1.6 | 21.9 | 9.8 | 2.2 | 0.25 | 0.15 |
| 5 | R1 | 18.1 | 41.6 | 4.5 | 0.5 | 11.1 | 2.1 | 13.6 | 8.5 | 2.2 | 0.06 | 0.21 |
| 6 | R2 | 17.7 | 35.8 | 8.6 | 0.4 | 11.4 | 1.9 | 17.1 | 7.1 | 2.0 | 0.00 | 0.22 |
| 7 | R3 | 25.4 | 26.6 | 4.9 | 0.5 | 16.2 | 2.3 | 13.6 | 10.5 | 1.0 | 0.02 | 0.30 |

height, specifically, the strength of an angle (33.2°), which was twice as wide as a Bragg angle when Co was a source.

Longitudinal cracks on a surface of a slab was checked. In this check, a surface of a cast slab was observed visually, and the length of an observed crack in a longitudinal direction was measured. At this time, if a crack of no less than 10 mm was detected, it was determined to form longitudinal cracks. In addition, temperature of a copper plate of the mold was measured upon continuous casting, and its temperature change was observed. From them, continuous casting and longitudinal cracks were evaluated for each test.

The symbols in the "Evaluation of Continuous Casting and Longitudinal Cracks" column in Table 5 represent the following:

○: represents that the temperature of a copper plate of the mold was stable upon continuous casting, the continuous casting was able to be completed, and no longitudinal crack formed on a surface of the cast slab; that is, "excellent".

Δ: represents that while the temperature of a copper plate of the mold changed upon continuous casting, the continuous casting was able to be completed, and longitudinal crack formed on a surface of the cast slab; that is, "failure".

x: represents that the temperature of a copper plate of the mold considerably changed upon continuous casting, and the continuous casting was stopped in the middle; that is, "failure".

Table 5 shows test numbers, grades of the mold flux, the Ti contents (mass %) in the molten steel, the ratio of the strength of perovskite to the strength of cuspidine (strength ratio) and evaluations of continuous casting and longitudinal cracks.

TABLE 5

| Test Number | Grade of Mold Flux | Ti Content in Molten Steel (mass %) | Strength Ratio | Evaluation of Continuous Casting and Longitudinal Cracks |
|---|---|---|---|---|
| 1 | A1 | 0.19 | 0.6 | ○ |
| 2 | A1 | 0.42 | 0.8 | ○ |
| 3 | A2 | 0.41 | 0.6 | ○ |
| 4 | A1 | 1.12 | 1.5 | x |
| 5 | R1 | 0.20 | 2.1 | x |
| 6 | R2 | 0.18 | 1.6 | Δ |
| 7 | R3 | 0.19 | 1.2 | Δ |

As seen from Tables 1 to 5, each MnO and $TiO_2$ content of the mold flux of all the test numbers 1 to 7 was less than 0.1 mass % in the initial composition. On the other hand, in the melting state, each MnO and $TiO_2$ content increased. From these results, it was confirmed that in the continuous casting of Ti-containing hypo-peritectic steel, the composition of the mold flux in the melting state changed according to oxidation reaction of Ti in the molten steel.

The index f(2) of the mold flux used in the test number 5, which was calculated from the initial composition, did not satisfy the formula (2). The indexes f(1) and f(2) of the mold flux used in the test numbers 6 to 7, which were calculated from the initial chemical composition, did not satisfy the formulas (1) and (2), respectively. As a result, in each test number 5 to 7, the strength ratio of the film took a value larger than 1.0, that is, formation of cuspidine was blocked. Therefore, the evaluation of continuous casting and longitudinal cracks was "failure".

In contrast, f(1), f(2) and f(3) of the mold flux used in each test number 1 to 3, which were calculated from the initial composition, satisfied the formulas (1), (2) and (3), respectively. In addition, the $TiO_2$ content of the melting mold flux was no more than 20 mass %, and the strength ratio of the film was less than 1.0. As a result, a state where cuspidine was dominant over perovskite was kept during the casting in each test number 1 to 3. Therefore, the evaluation of continuous casting and longitudinal cracks was "excellent".

The indexes f(1), f(2) and f(3) of the mold flux used in the test number 4, which were calculated from the initial composition, satisfied the formulas (1), (2) and (3), respectively. However, in the test number 4, the Ti content of the molten steel was over 1.0 mass %, and thus the $TiO_2$ content of the melting mold flux was over 20 mass %. Thus, the composition change in the melting mold flux was large. As a result, the strength ratio of the film took a value larger than 1.0, that is, formation of cuspidine was blocked. Therefore, the evaluation of continuous casting and longitudinal cracks was "failure".

From these results, it was made clear that according to the mold flux and the continuous casting method of this invention, the state where cuspidine was dominant over perovskite was able to be kept in a crystal phase of the film, and longitudinal cracks on a surface of a slab was able to be prevented.

While this invention has been described concerning the embodiments that are considered to be the most practical and preferable at present, this invention is not limited to the embodiments disclosed in this description, and can be properly modified within the scope not contrary to the gist and ideas of this invention readable from the claims and whole of the description, and it should be understood that mold flux for continuous-casting Ti-containing hypo-peritectic steel and a continuous casting method with such modification are also encompassed within the technical range of this invention.

INDUSTRIAL APPLICABILITY

According to the mold flux and the continuous casting method of this invention, the effect of lubricity and mild cooling in the mold is stable, and longitudinal cracks on a surface of a slab can be prevented from forming. Thus, they can be effectively used in continuous casting of hypo-peritectic steel containing 0.1 to 1 mass % of Ti.

REFERENCE SIGNS LIST

1 . . . mold flux for continuous-casting Ti-containing hypo-peritectic steel
2 . . . submerged nozzle
3 . . . mold
4 . . . molten steel
5 . . . solidified shell
6 . . . rolls
7 . . . cooling water
8 . . . film

The invention claimed is:

1. A method for continuous-casting Ti-containing hypo-peritectic steel, the method comprising: continuous-casting hypo-peritectic steel containing 0.1 to 1 mass % of Ti, using a mold flux, wherein the mold flux contains CaO, $SiO_2$, an alkali metal oxide and a fluorine compound as major components, a chemical composition of the mold flux before the mold flux is put into a mold satisfies the formulas (1), (2) and (3), a $TiO_2$ content of the mold flux in a melting state during the casting is no more than 20 mass %, and a strength ratio of a film of the mold flux in a solidifying state after the casting is no more than 1.0:

$$1.1-0.5\times T\leq f(1)\leq 1.9-0.5\times T \quad (1)$$

$$0.05\leq f(2)\leq 0.40 \quad (2)$$

$$0\leq f(3)\leq 0.40 \quad (3),$$

wherein in the formulas (1) to (3), $$f(1)=(CaO)_h/(SiO_2)_h \quad (A)$$

$$f(2)=(CaF_2)_h/\{(CaO)_h+(SiO_2)_h+(CaF_2)_h\} \quad (B)$$

$$f(3)=\{(\text{alkali metal fluoride})_h\}/\{(CaO)_h+(SiO_2)_h+(\text{alkali metal fluoride})_h)\} \quad (C),$$

wherein in the formulas (A) to (C), $$(CaO)_h=W_{CaO}-(CaF_2)_h\times 0.718 \quad (D)$$

$$(SiO_2)_h=W_{SiO2} \quad (E)$$

$$(CaF_2)_h=(W_F-W_{Li2O}\times 1.27-W_{Na2O}\times 0.613-W_{K2O}\times 0.403)\times 2.05 \quad (F)$$

$$(\text{alkali metal fluoride})_h=W_{Li2O}\times 1.74+W_{Na2O}\times 1.35+W_{K2O}\times 1.23 \quad (G)$$

wherein T is a Ti content of molten steel (mass %), $W_{CaO}$ is a CaO content of the mold flux (mass %), $W_{SiO2}$ is a $SiO_2$ content of the mold flux (mass %), $W_F$ is a F content of the mold flux (mass %), and $W_{Li2O}$, $W_{Na2O}$ and $W_{K2O}$ are contents of $Li_2O$, $Na_2O$ and $K_2O$ respectively, which are alkali metal oxides, of the mold flux (mass %), and wherein the strength ratio of the film means a ratio of a first peak height of perovskite to a first peak height of cuspidine, the ratio being obtained from X-ray diffraction analysis of powder obtained by pulverizing the film of the mold flux.

* * * * *